US006238543B1

(12) United States Patent
Law, Jr. et al.

(10) Patent No.: US 6,238,543 B1
(45) Date of Patent: May 29, 2001

(54) KOLBE ELECTROLYSIS IN A POLYMER ELECTROLYTE MEMBRANE REACTOR

(75) Inventors: Clarence Garland Law, Jr., Franklin, TN (US); Peter S. Fedkiw, Raleigh, NC (US); Michael T. Hicks, Inver Grove Heights, MN (US)

(73) Assignees: E. I. du Pont de Nemours and Company, Wilmington, DE (US); University of North Carolina, Chapel Hill, NC (US)

( * ) Notice: Subject to any disclaimer, the term of this patent is extended or adjusted under 35 U.S.C. 154(b) by 0 days.

(21) Appl. No.: 09/174,197

(22) Filed: Oct. 16, 1998

Related U.S. Application Data

(60) Provisional application No. 60/063,758, filed on Oct. 17, 1997.

(51) Int. Cl.[7] ..... C25B 3/10; C25B 3/00
(52) U.S. Cl. ..... 205/415; 205/440
(58) Field of Search ..... 205/415, 440

(56) References Cited

PUBLICATIONS

Ogumi et al., "Application of the Solid Polymer Electrolyte (SPE) Method to Organic Electrochemistry—III. Kolbe Type Reactions on Pt–SPE", Electrochimica Acta, vol. 28, No. 11, pp. 1687–1693, 1983 no month available.*
Yan et al., "A Model for the Kolbe Reaction of Acetate in a Parallel–Plate Reactor", J. Appl. Electrochem., vol. 26, No. 2, pp. 175–185. abstract only, 1996 no month available.*
D. A. White, *Organic Syntheses*, Collective vol. 7, 181–185, 1990 no month available.
Z. Ogumi et al., *Electrochimica Acta*, 28, No. 11, 1687–1693, 1983 no month available.

* cited by examiner

*Primary Examiner*—Edna Wong

(57) ABSTRACT

Disclosed is a process, for the electrolytic coupling of carboxylic acids, carried out in a polymer electrolyte membrane reactor. The reactor design (1) discloses the use of gaseous or neat liquid reactants without the use of organic cosolvents, (2) prevents the loss of platinum, and (3) permits the use of oxygen reduction to water as the cathode reaction.

9 Claims, 12 Drawing Sheets

KOLBE ELECTROLYSIS IN A POLYMER ELECTROLYTE MEMBRANE REACTOR

This application claims benefit of Provisional Application No. 60/063,758, filed Oct. 17, 1997.

FIELD OF THE INVENTION

This invention concerns a process for the electrolytic coupling of carboxylic acids, the process carried out in a polymer electrolyte membrane reactor.

TECHNICAL BACKGROUND OF THE INVENTION

The electrolytic coupling of carboxylic acids, i.e. the Kolbe reaction, is usually carried out in a parallel plate reactor, in the presence of aqueous solvents, organic cosolvents and added salt electrolytes. Furthermore, it is common for the platinum anode electrode material to be consumed during the course of the reaction. Another disadvantage is the potential evolution of hydrogen gas at the cathode with concomitant safety concerns. The following disclosures may be relevant to various aspects of the present invention and may be briefly summarized as follows:

Organic Syntheses, Collective Volume 7, John Wiley and Sons, N.Y., N.Y., 1990, pages 181–185, describes a classical method for the synthesis of dimethyl decanedioate from methyl hydrogen hexanedioate (adipic acid, monomethyl ester).

Z. Ogumi et al., Electrochimica Acta, Vol. 28, No. 11, pp 1687–1693, 1983 discloses the use of platinum catalyst supported on solid polymer electrolyte material as electrodes in the electrolytic coupling of carboxylic acids where cosolvents were added to maintain the polymer electrolytes conductivity. Ogumi discloses the use of a solid polymer electrolyte material coated with catalyst on one side which functioned as an electrode and separator, but not as an electrolyte, in a two chamber electrolytic cell. Ogumi also discloses the use of a solid polymer electrolyte material coated with catalyst on both sides which functioned as an electrode, but not as a separator, in an electrolytic cell.

SUMMARY OF THE INVENTION

Briefly stated, and in accordance with one aspect of the present invention, there is provided an improved process for the preparation of organic compounds of the structure (II) from one or more carboxylic acids of the structures (I) and (I') according to the equation $$\underset{(I)}{RCH_2COOH} + \underset{(I')}{R'CH_2COOH} + \tfrac{1}{2}O_2 \longrightarrow \underset{(II)}{RCH_2{-}CH_2R'} + 2\,CO_2 + H_2O$$

where R and R' are independently selected from the group consisting of hydrogen, alkyl containing from about one to about six carbon atoms, substituted alkyl, phenyl, substituted phenyl, aralkyl and ring-substituted aralkyl, the process comprising the steps of:

a) introducing (I) and (I') in the vapor state or as neat organic liquids in the absence of an organic solvent to the anode side of a polymer electrode membrane reactor;

b) supplying, concurrently, an oxygen carrying gas to the cathode side of the reactor;

c) passing at least one equivalent of electrical current through the polymer electrode membrane reactor resulting in the formation of the compound (II) on the anode side of the reactor and the formation of water on the cathode side of the reactor; and d) isolating the compound (II) from the anode side effluent from the polymer electrode membrane reactor. In the above process the polymer electrode membrane reactor may comprise a gas manifold, flow channels, a membrane electrode assembly, and a current collector.

Pursuant to another aspect of the present invention, there is provided a process for the preparation of organic compounds of the structure (II) from one or more carboxylic acids of the structures (I) and (I') according to the equation $$\underset{(I)}{RCH_2COOH} + \underset{(I')}{R'CH_2COOH} \longrightarrow \underset{(II)}{RCH_2{-}CH_2R'} + 2\,CO_2 + H_2$$

where R and R' are independently selected from the group consisting of hydrogen, alkyl containing from about one to about six carbon atoms, substituted alkyl, phenyl, substituted phenyl, aralkyl and ring-substituted aralkyl, said process comprising the steps of:

a) introducing (I) and (I') in the vapor state or as neat organic liquids in the absence of an organic solvent to the anode side of a polymer electrode membrane reactor;

b) passing at least one equivalent of electrical current through the polymer electrode membrane reactor resulting in the formation of the compound (II) on the anode side of said reactor and the formation of hydrogen on the cathode side of said reactor; and c) isolating the compound (II) from the anode side effluent from the polymer electrode membrane reactor. In this second process the polymer electrode membrane reactor may comprise a gas manifold, flow channels, a membrane electrode assembly, and a current collector.

DETAILED DESCRIPTION OF THE INVENTION

Figure 1:
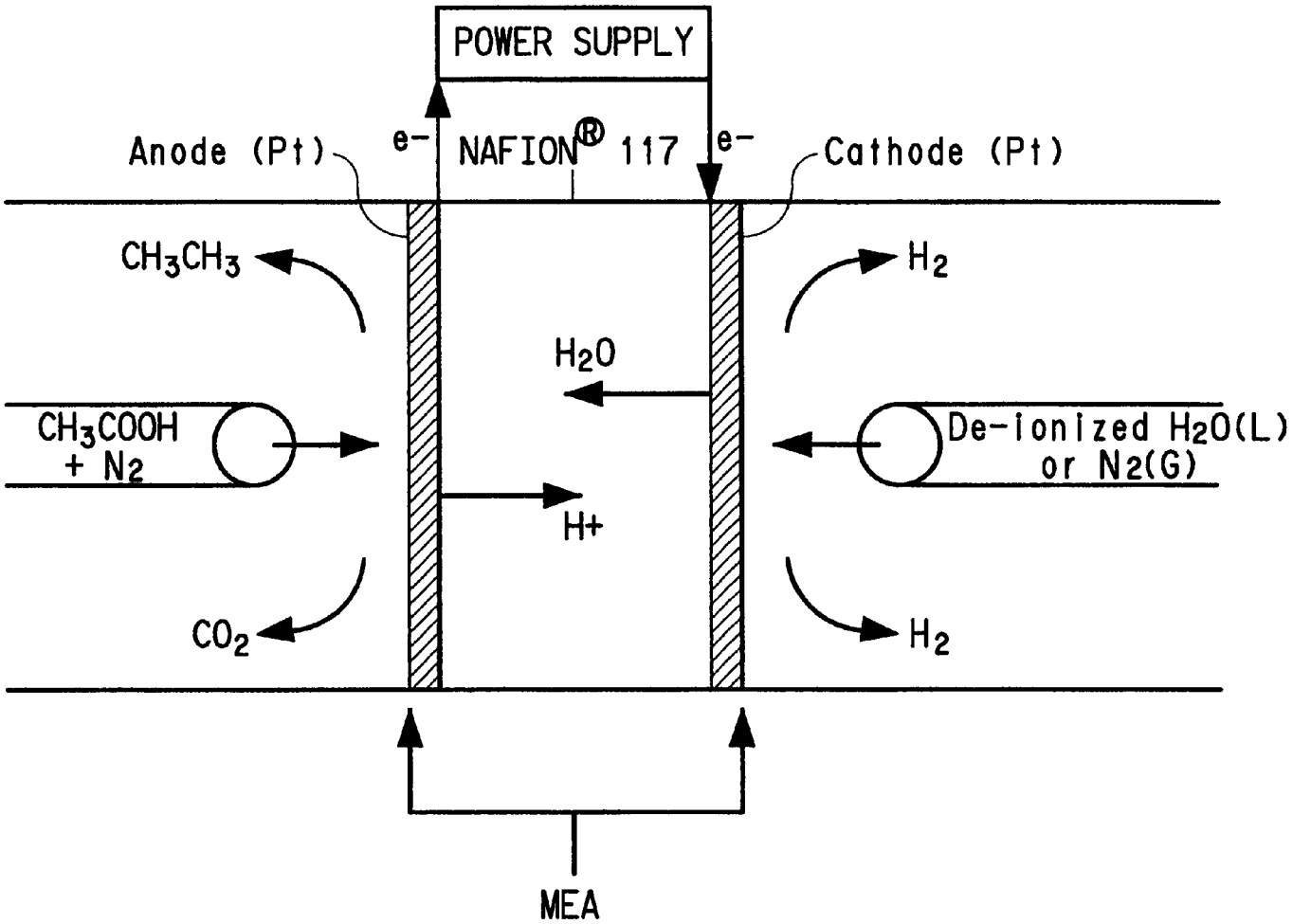
FIG. 1 is a schematic representation of the process of an embodiment of the present invention showing a polymer electrolyte membrane (PEM) cell for Kolbe electrolysis of acetic acid vapor with hydrogen evolution as the cathode reaction.

In the electrolytic coupling of carboxylic acids, i.e. the Kolbe reaction, as heretofore practiced, a main disadvantage is the requirement for the use of a cosolvent for the reagents. This is due to the requirement for electrical conductivity. Often, to increase conductivity, ionic species are added to the electrolyte. The presence of solvent and electrolytes greatly complicates the isolation of pure products from such systems. In the present invention, the process which carries out the electrolytic coupling in the vapor state or as neat organic liquids in the absence of an organic solvent greatly simplifies product isolation.

The advantages that accrue to the process of the present invention are derived from it being carried out in a PEM reactor apparatus comprising a membrane electrode assembly.

The reactor uses a two-sided catalyst (preferably platinum) coated Nafion® 117 PEM simultaneously as the electrolyte and separator, and in this manner eliminates the need for an additional electrolyte, aqueous solvent, and organic co-solvent. Since, in one embodiment, gas may be fed directly to the anode and/or cathode, solubilized platinum, formed by oxidation of the anode, is not dissolved or lost in a liquid electrolyte but remains confined within the PEM.

Another advantage of the PEM cell of the present invention is that oxygen reduction to water may be used as the cathode reaction. In this manner, energy consumption is less than if the reduction of protons to hydrogen is used as the cathode reaction, and the water by product may be used to hydrate the PEM. The hazards associated with hydrogen evolution at the cathode are thereby eliminated.

Carboxylic acids or mixtures of carboxylic acids may be used as starting material for an embodiment of the process of the present invention. A single carboxylic acid is preferred.

The carboxylic acids may be fed to the PEM reactor in the vapor state. In this embodiment, the carboxylic acids must have substantial vapor pressures at the temperature of operation of the cell. Alternatively, the carboxylic acids may be fed as neat liquids, in which case, the carboxylic acids must have melting points below the temperature of operation of the cell. The use of carboxylic acids in the vapor phase is preferred.

The carboxylic acids suitable for use herein include: lower alkane carboxylic acids and substituted lower alkane carboxylic acids. This group includes chlorine substituted lower alkane carboxylic acids and fluorine substituted lower alkane carboxylic acids, in which case the products comprise hydrochlorocarbon and hydrofluorocarbon compounds. Such hydrochloro compounds and, especially hydrofluoro compounds, may find use as chlorofluorocarbon replacement compounds.

When the carboxylic acids are fed to the PEM reactor in the vapor phase, it may be advantageous to co-feed an inert carrier gas with the carboxylic acid to help with sweeping the coupling products from the reaction zone for subsequent recovery.

The process of the present invention is typically operated at any temperature between the freezing point of the carboxylic acids up to the temperature where the polymer membrane fails. The upper temperature limit is thus limited to about 120° C.

In the preferred embodiment, the advantages of the process of the present invention are derived from the use of an electrochemical cell that uses a membrane electrode assembly (MEA) simultaneously as an electrode, electrolyte and separator. In one embodiment, water is supplied to the cathode compartment to maintain ionic conductivity. In a second embodiment, oxygen or an oxygen containing gas is fed to the cathode compartment of the cell, water is thus produced at the cathode. The water produced and, if necessary, a supply of additional water will ensure that the membrane is well hydrated.

Figure 2A:
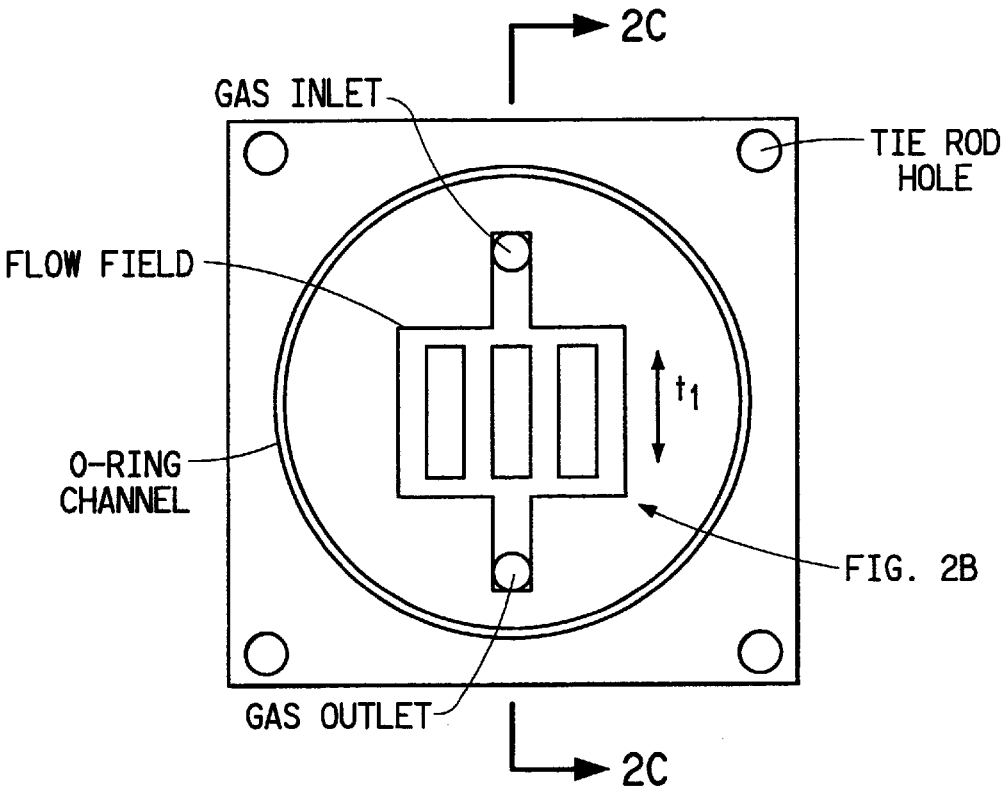
FIGS. 2A–2D provides a schematic top view and cross sectional views of the PEM reactor employed in the process of an embodiment of the present invention.
Figure 2B:
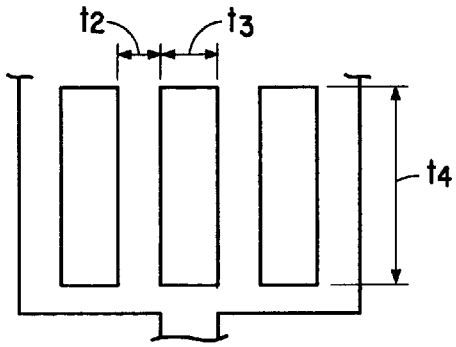
Figure 2C:
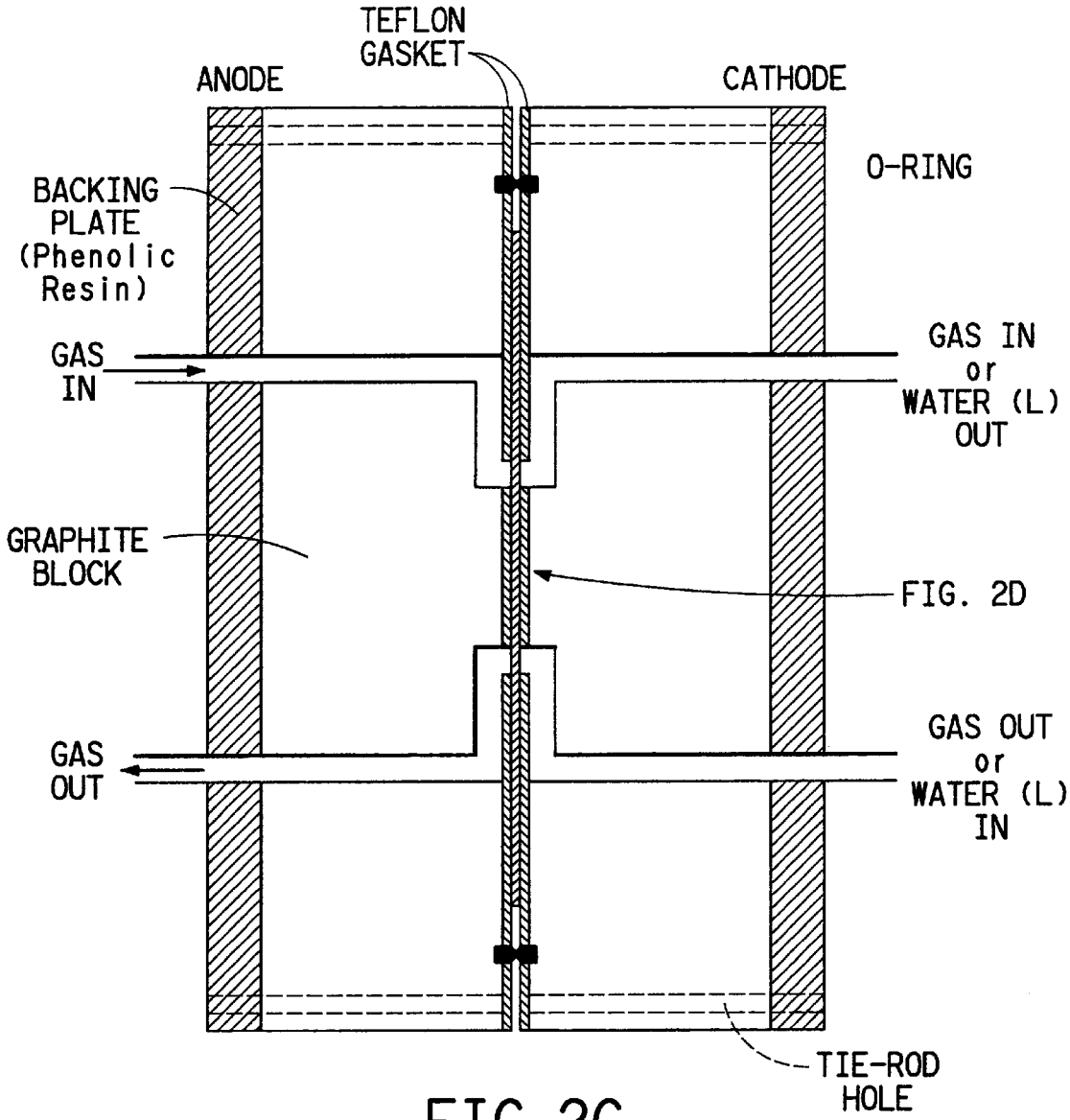
Figure 2D:
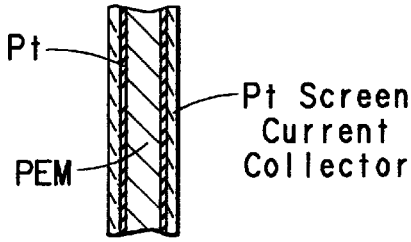

Reference is now made to FIGS. 2A–2D to describe the apparatus and conditions for a cell operation. The reactor is shown in FIGS. 2A–2D in a top view (FIG. 2A) and cross-sectional views (FIGS. 2C and 2D), that include details of the flow channels. FIG. 2B shows an enlarged view of a flow field embodiment where $t_2$ is about 1.7 mm, $t_3$ is about 1.6mm, $t_4$ is about 8.3 mm, and $t_1$ (shown in FIG. 2A) is about 12 mm and the depth of the flow channel, not shown can be about 4.5 mm. The reactor consists of a membrane electrode assembly "sandwiched" between two graphite blocks (AXF-5Q graphite, POCO Graphite Inc.) in which a flow field is machined to create a working and counter electrode compartment. Both the working and counter electrode are platinum, and a Pt 52 mesh screen (1.1×1.1 cm) serves as a current collector for each electrode to provide contact between the MEA and the graphite blocks. A 121 micrometer thick Teflon® gasket is used to electrically isolate the graphite blocks and to mask all but 1.21 $cm^2$ (1.1×1.1 cm) of electrode area on the MEA. The two cell-halves were pressed together by tie-rods placed through phenolic resin backing plates as shown in FIG. 2C.

A mass flow controller (Hasting Instruments model HFC-202) was used to control the nitrogen flow through a thermostatted gas washing bottle containing acetic acid (Fisher Scientific, reagent grade). The nitrogen/acetic acid mixture then enters the reactor, flows into a gas chromatograph (GC) for sample analysis, and is vented. The cathode compartment was fed either humidified nitrogen or de-ionized liquid water (FMl pump model RPD). In the former case, a mass flow controller (Hasting Instruments model HFC-203) was used to control the nitrogen flow through a thermostatted gas washing bottle containing Milli-Q de-ionized water. All gas containing lines were heat traced at ~85° C. to prevent condensation, and the PEM cell was located in an oven (Fisher Scientific model 615F) for temperature control. The cell current was controlled by an EG&G PAR Model 173 potentiostat/galvanostat equipped with an EG&G PAR Model 179 digital coulometer. The cell potential and current were recorded on an ABB Model SE 120 stripchart recorder. A 6 fit.×⅛ inch Porapak Q® column (Alltech) was used to separate $N_2$, $CO_2$, $CH_3CH_3$, $H_2O$, and $CH_3COOH$, but quantitative analysis was done for the first three species only. In no case was the Hofer-Moest side product of methanol from the oxidation of acetic acid detected. The column was placed in a Perkin Elmer Sigma 8500 gas chromatograph which was connected to a Perkin Elmer Omega-2 data station and printer. The GC carrier gas was He and its flowrate was 30 mL/min. A heated (225° C.), ten-port valve (Valco) was used for on-line gas sampling with a 0.5 mL sample loop. After sample injection, the column temperature was held at 75° C. for 2.5 minutes, then increased at a rate of 30° C/min to 200° C. and held at 200° C. for 2.4 minutes. It took approximately 1.5 minutes for the gas stream to travel from the reactor to the GC for analysis. In comparison, the CC analysis lasts about nine (9) minutes.

The advantages of the process of the present invention are derived from the cell, of which the key part is the membrane electrode assembly (MEA). Nafion® 117 was the membrane for all experiments. Other grades of Nafion® ion exchange perfluorinated ion-exchange polymer may be employed. Perfluorinated ion-exchange polymers from other suppliers may also be employed.

The MEA may be made in a variety of ways; however, technologies for fabricating carbon-supported electrodes for a PEM fuel cell could not be used due to the high anodic potentials associated with the Kolbe reaction which oxidatively destroy the carbon. Consequentially, noncarbon based techniques were used to fabricate MEAs for the results presented here. In the first method, a nonequilibrium Impregnation-Reduction (I-R) technique [R. Liu et al, J. Electrochem. Soc., 139, 15 (1992); U.S. Pat. No. 4,959,132] was used to fabricate MEAs in which a thin, porous Pt layer was chemically deposited on each surface. These MEAs are referred to as I-R MEAs. Pt loadings from about 0.37 to about 1.13 mg Pt/cm$^2$ were obtained.

In a second method, MEAs were formed by hot pressing (152 MPa at 204° C.) a tetrabutylammonium ($TBA^+$) Nafion®-coated Pt screen (52 mesh) onto a dry, $Na^+$ Nafion® 117 followed by leaching of the $TBA^+$ in a peroxide solution (10 wt. % $H_2O_2$ at 80° C. for about 12 hours). These MEAs are referred to as HP MEAs. This procedure is similar to the thin-film, ink-cast method of Wilson et al. Electrochim. Acta, 40, 355(1995).

Example 2 gas-fed anode and liquid-fed cathode with reactor temperature less than acetic acid dew point (i.e., acetic acid condensation in reactor).

Example 3 gas-fed anode and cathode with reactor temperature less than or equal to acetic acid and water dew point (i.e., acetic acid and water condensation in reactor).

TABLE 1

| | | Reaction Conditions | | | | | | | | | |
|---|---|---|---|---|---|---|---|---|---|---|---|
| Example No. | Feed Conditions | $N_2$ Flow to Gas Bubbler (SCCM) (1)—Acetic Acid (2)—Deionized Water | Acetic Acid Gas Bubbler Temp[a] (° C.) | Acetic Acid Partial Pressure (mm Hg) | Acetic Acid Mole Fract. In Vapor[b] | Water Gas Bubbler Temp.[a] (° C.) | Water Partial Pressure (mm Hg) | Water Mole Fract. In Vapor[b] | Liquid Water Temp. (° C.) | Liquid Water Flow (mL/min) | Reactor Temp (° C.) |
| 1 | $T_{rxt} > T_{d.p.}$ Liquid-fed cathode | (1) 100 | 50 | 58 | 0.08 | — | — | — | 60 | 100 | 60 |
| 2a | $T_{rxt} < T_{d.p.}$ | (1) 100 | 75 | 172 | 0.23 | — | — | — | 50 | 100 | 50 |
| 2b | Liquid-fed cathode | (1) 100 | 50 | 58 | 0.08 | — | — | — | 42 | 100 | 42 |
| 3a | $T_{rxt} \leqq T_{d.p.}$ | (1) & (2) 100 | 75 | 172 | 0.23 | 80 | 355 | 0.47 | — | — | 50 |
| 3b | Gas-fed | (1) & (2) 100 | 75 | 172 | 0.23 | 88 | 487 | 0.64 | — | — | 50 |
| 3c | cathode | (1) & (2) 100 | 58 | 84 | 0.11 | 90 | 526 | 0.69 | — | — | 50 |
| 3d | | (1) & (2) 100 | 50 | 58 | 0.08 | 90 | 526 | 0.69 | — | — | 50 |
| 3e | | (1) & (2) 100 | 50 | 58 | 0.08 | 90 | 526 | 0.69 | — | — | 34 |

Notes:
[a]Temperature of bath
[b]Calculation based on assumed 760 mm Hg in gas bubbler
$T_{rxt}$ = Reactor temperature
$T_{d.p.}$ = Dew point temperature The third method is a combination of the previous two techniques. A 52-mesh Pt screen was hot-pressed onto Nafion® 117, followed by deposition of platinum via the nonequilibriumn Impregnation-Reduction method. The Pt screen (see FIG. 2D) serves to improve electrical contact to the deposited platinum layer. These MEAs are referred to as HP I-R MEAs. Pt loadings (in excess of the screen) of from about 0.35 to about 0.58 mg Pt/cm$^2$ were obtained.

The room-temperature cell resistance was measured via impedance spectroscopy prior to and after each experiment and the average is reported. EG&G PAR Model 398 Electrochemical Impedance software was used to control the potentiostat (EG&G PAR model 273) in conjunction with a lock-in amplifier (EG&G PAR model 5210). The impedance was measured at 15 frequencies between about 103 to about 105 Hz. The real component of the impedance at about 105 Hz is recorded as the cell resistance.

EXAMPLES

A description of the three Examples and the operating conditions are provided below and in Table 1:

Example 1 gas-fed anode and liquid-fed cathode with reactor temperature greater than acetic acid dew point (i.e., no acetic acid condensation in reactor).

The polarization, product ratio Pr (i.e., the molar ratio of ethane to carbon dioxide), and current efficiency results are presented in FIGS. 3 to 5. The Kolbe product selectivity is referenced in the discussion which follows and is defined as Pr/(1+Pr). The current efficiency is calculated from the measured ethane production rate and the known current. Steady-state cell potentials were rarely obtained, but stationary-state potentials were normally found, i.e., the cell potential oscillated around a constant value. The oscillations varied from about 0 to about 15 percent of the mean potential with a typical value of about 5 percent. The stationary potentials are reported in FIGS. 3 to 5. The typical, average-cell resistance for the I-R, HP, and HP I-R MEAs was about 3, 0.7, and 1 ohm, respectively, for a liquid-fed cathode; and 8 ohms for the I-R and HP I-R MEAs for a humidified nitrogen-fed cathode. For all MEAs with a liquid-fed cathode, the end-of-run cell resistance decreased but was typically within about 25 percent of its initial value; but for a gas-fed cathode, it increased and also was typically within about 25 percent.

Figure 3A:
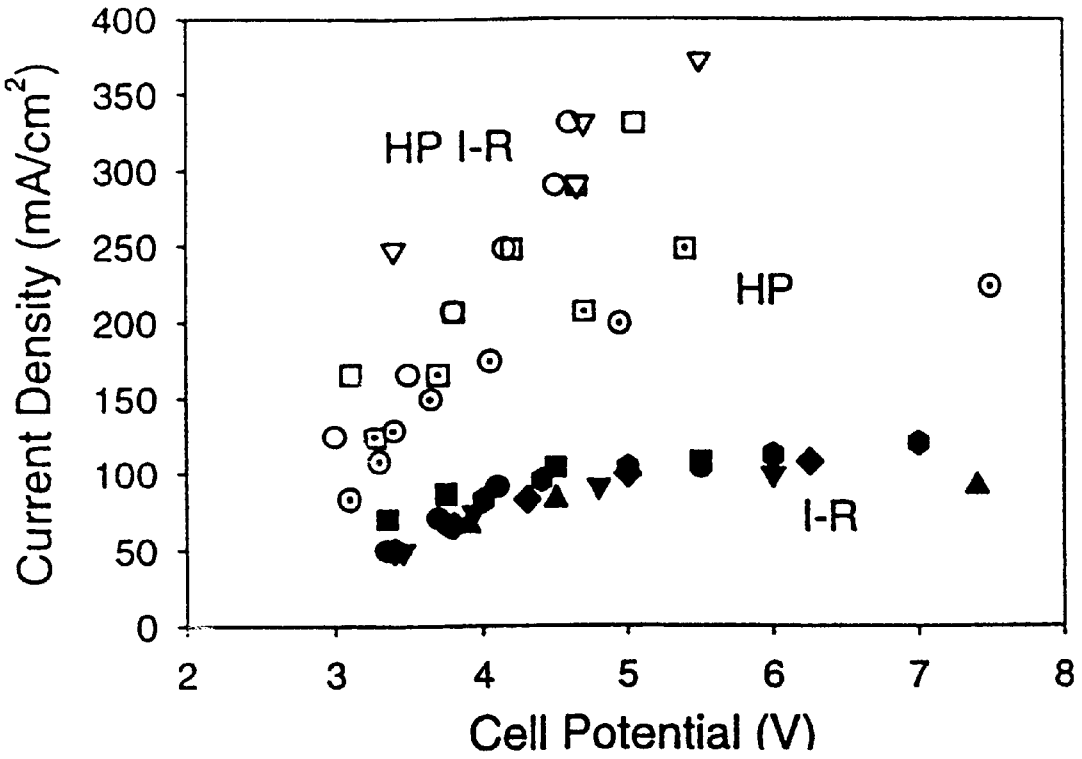
FIGS. 3A–3C are graphical representations of the results of Example 1 in Table 1.
Figure 3B:
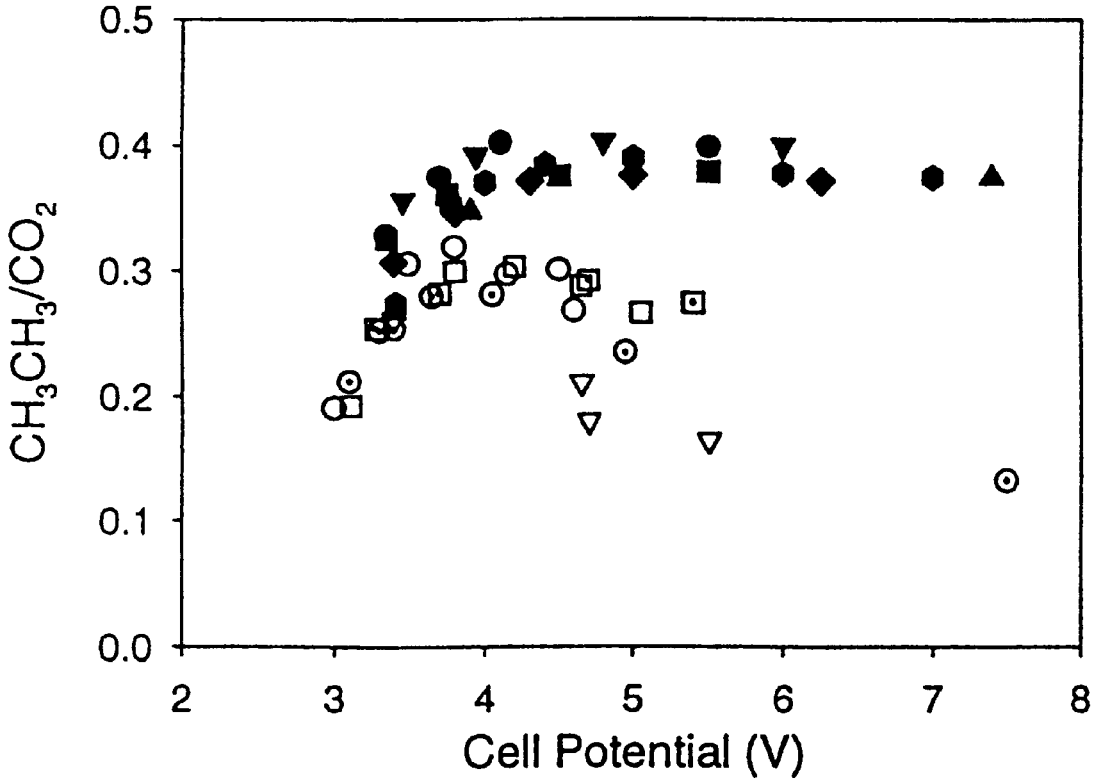
Figure 3C:
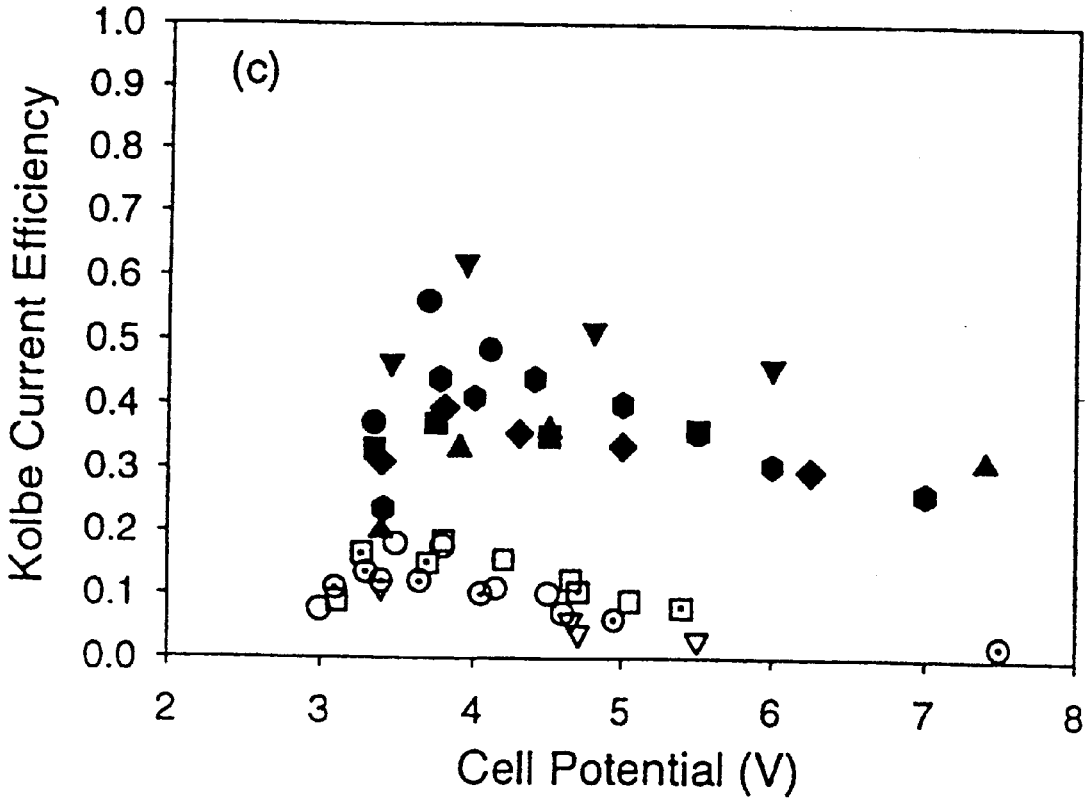

Reference is now made to FIGS. 3A–3B, which show graphically the results for Example 1 of the PEM reactor of a variable versus cell voltage. The results shown graphically are from using a gas-fed anode and liquid-fed cathode with reactor temperature (60° C.) greater than acetic acid gas bubbler temperature (50° C.) wherein the variable is: current density in FIG. 3A; mole ratio of $CH_3CH_3/CO_2$ in FIG. 3B; and Kolbe current efficiency in FIG. 3C. The filled symbols in these figures indicate multiple experimental runs with I-R MEAs, the center-dot symbols indicate two experimental runs with HP MEAs, and the unfilled symbols indicate three experimental runs with HP I-R MEAs. The current density increases with cell potential, and the results for the IR and HP MEAs indicate an apparent mass-transport limited current. The product ratio increases with cell potential for the I-R MEAs and approaches the theoretical limit of one-half (determined from reaction stoichiometry) but does not exceed 0.41. For the HP and HP I-R MEAs, the product ratio is always less than one-third and does not approach the theoretical limit as the potential is increased. The Kolbe current efficiency exhibits a maximum at a cell potential of about 3.5- about 4 V in the range of about 40 to about 60 percent for the I-R MEAs and about 20 percent for the HP and HP I-R MEAs.

Figure 4A:
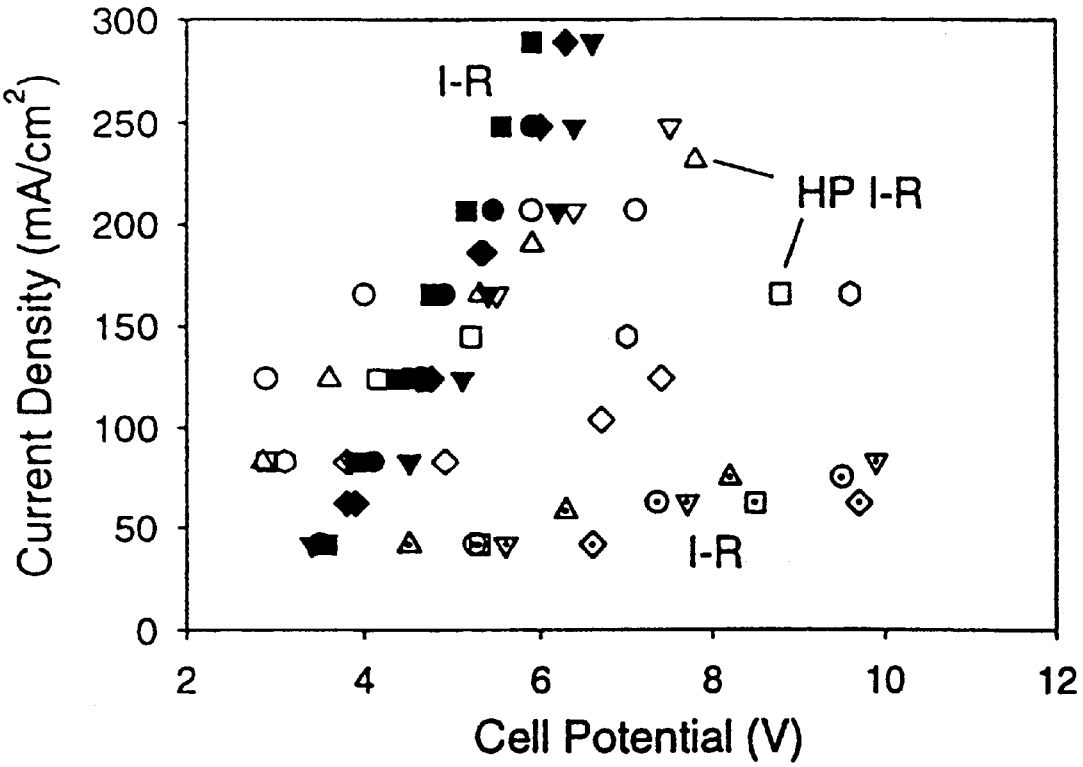
FIGS. 4A–4C are graphical representations of the results of Examples 2a and 2b in Table 1.
Figure 4B:
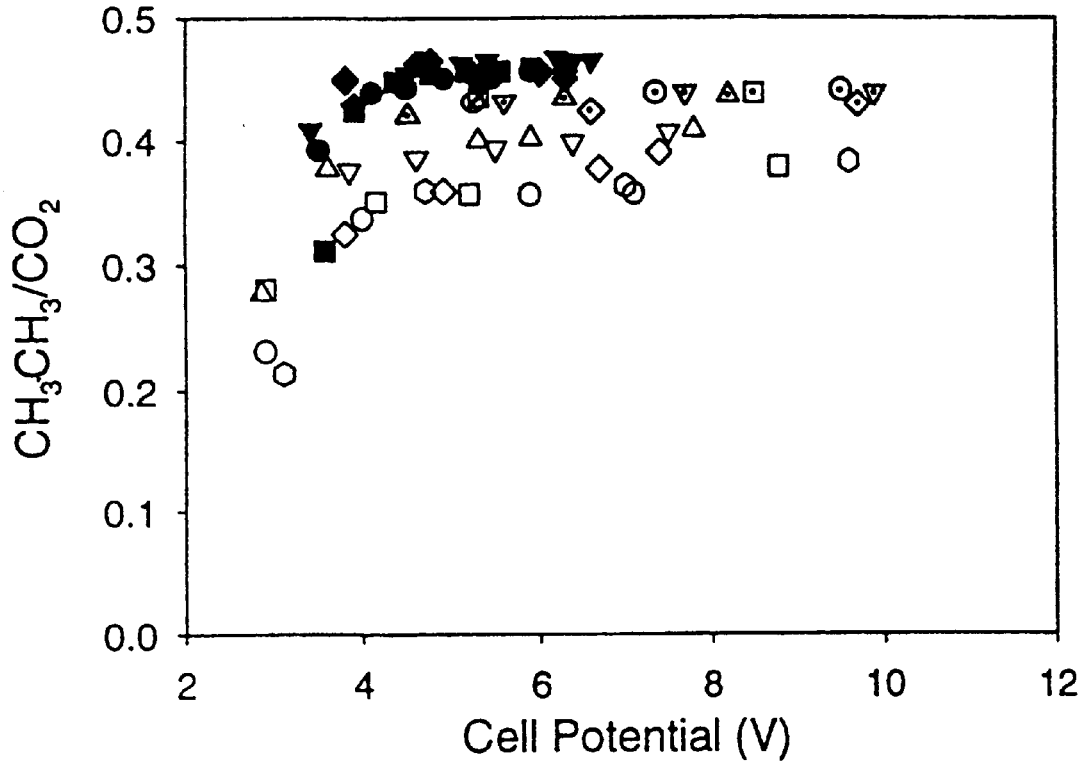
Figure 4C:
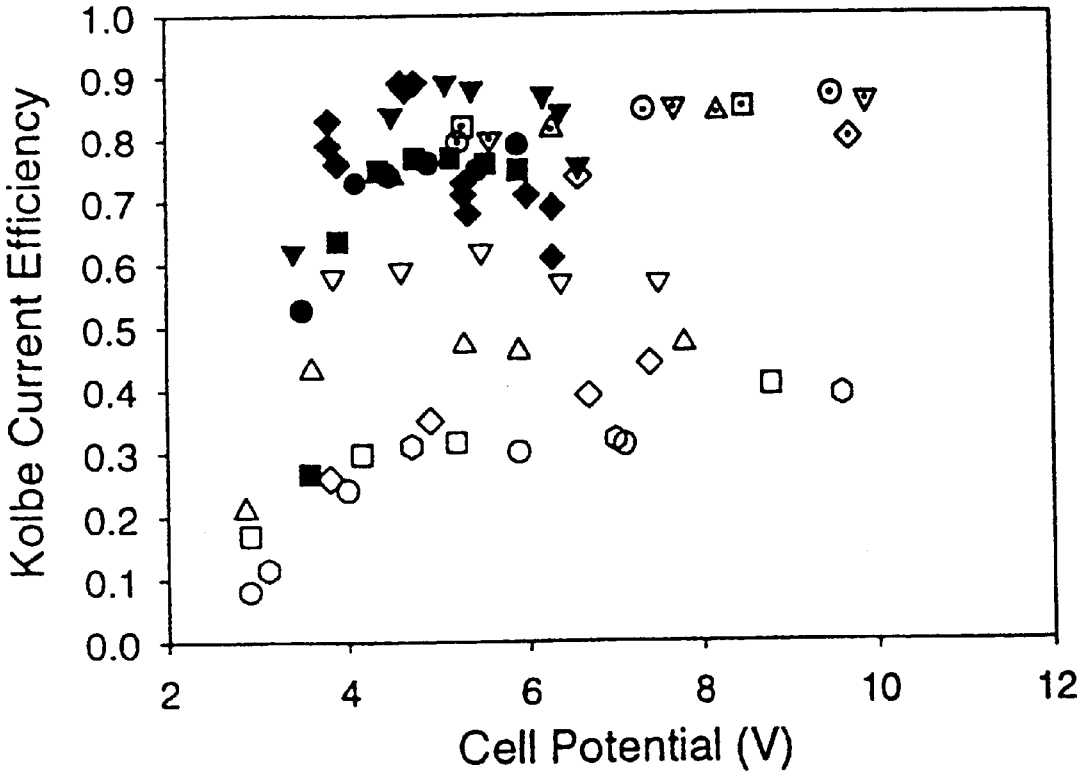

Reference is now made to FIGS. 4A–4C, which show graphically the results of the PEM reactor of a variable versus cell voltage. The results shown graphically are from using a gas-fed anode and liquid-fed cathode with reactor temperature less than an acetic acid gas bubbler temperature wherein the variable is: current density in FIG. 4A; mole ratio of $CH_3CH_3CO_2$ in FIG. 4B; and Kolbe current efficiency in FIG. 4C. The filled symbols in these figures indicate four experimental runs with I-R MEAs with 50° C. acetic acid gas bubbler and 42° C. reactor, the center-dot symbols indicate five experimental runs with I-R MEAs with 75° C. acetic acid gas bubbler and 50° C. reactor, and the unfilled symbols indicate six experimental runs with HP I-R MEAs with 75° C. acetic acid gas bubbler and 50° C. reactor. Results are presented in FIGS. 4A–4C for Examples 2a and 2b, two different reaction conditions, each with acetic acid condensation occurring in the cell. For either operating condition, the current density increases with cell potential and the product ratio increases monotonically to a MEA dependent value between about 0.35 to about 0.47. The Kolbe current efficiencies vary between about 70 to about 90 percent for the I-R MEAs and between about 30 to about 70 percent for the HP I-R MEAs.

Figure 5A:
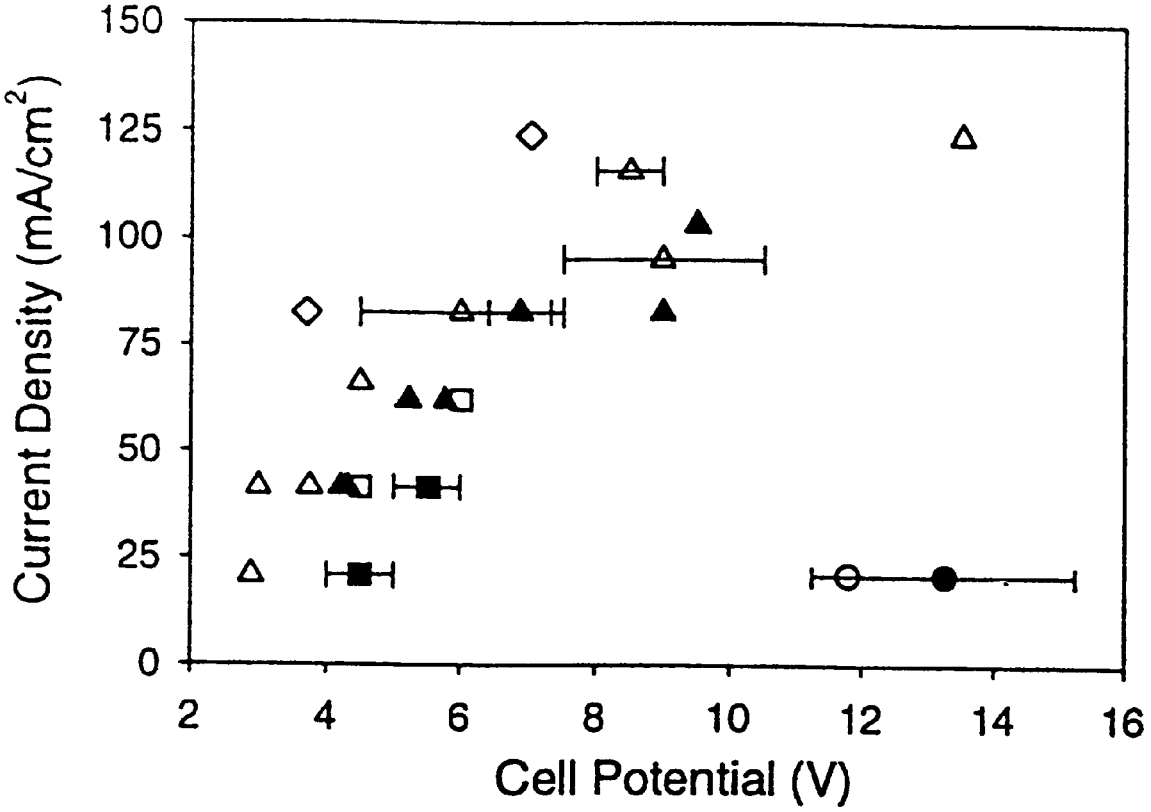
FIGS. 5A–5C are graphical representations of the results of Examples 3a–3e in Table 1.
Figure 5B:
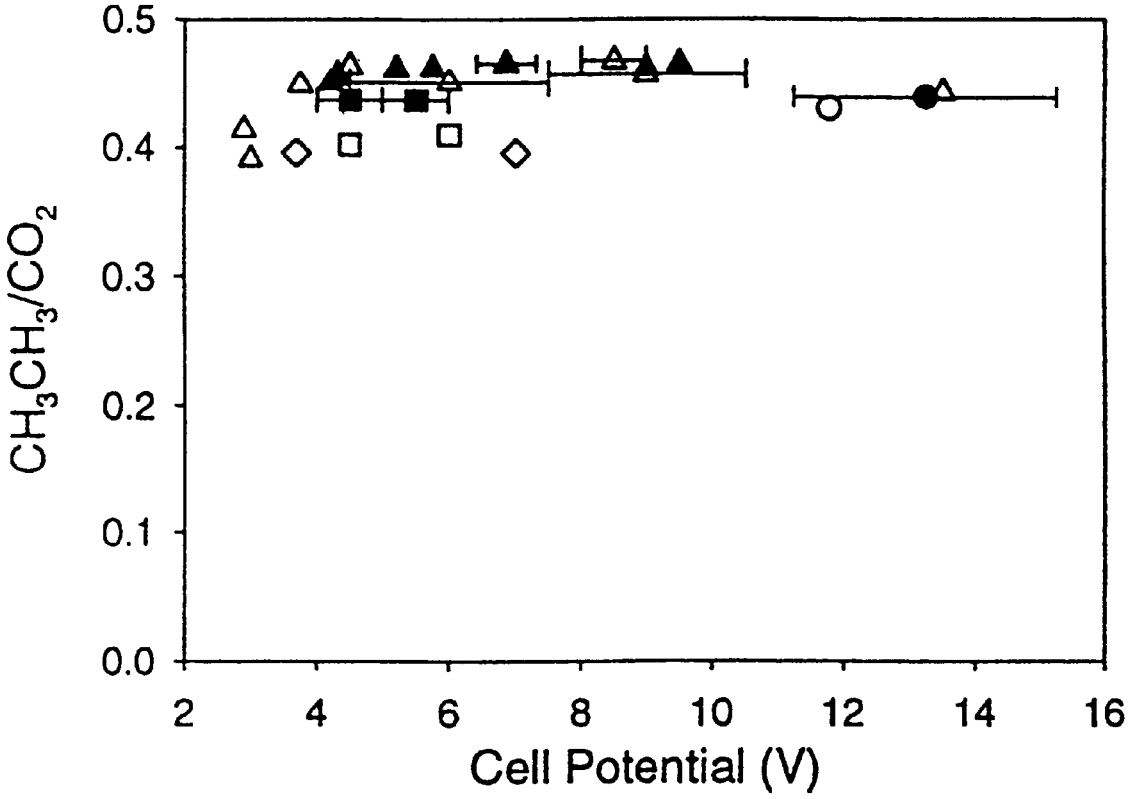
Figure 5C:
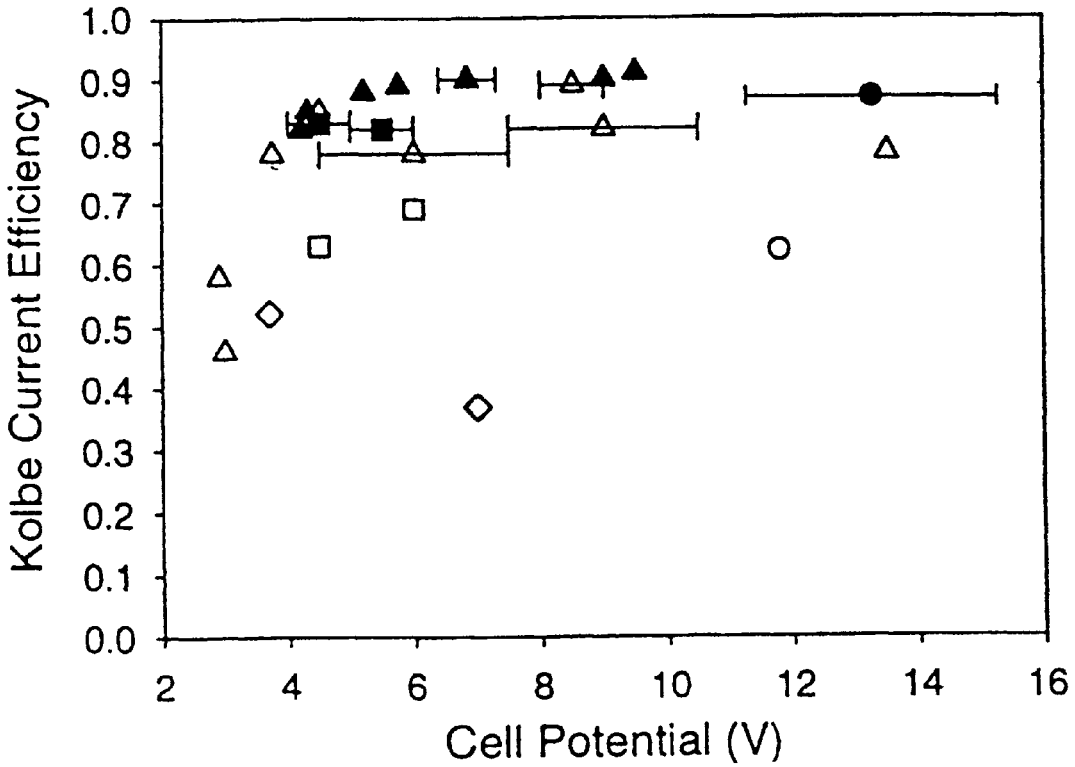

Reference is now made to FIGS. 5A–5C, which show graphically the results of the PEM reactor of a variable versus cell voltage. The results shown graphically are from using a gas-fed anode and cathode with reactor temperature less than or equal to an acetic acid gas bubbler temperature wherein the variable is: current density in FIG. 5A; mole ratio of $CH_3CH_3/CO_2$ in FIG. 5B; and Kolbe current efficiency in FIG. 5C. The filled symbols in these figures indicate I-R MEAs, the unfilled symbols indicate HP I-R MEAs, the circle symbol indicates acetic acid gas bubbler temperature of 75° C. and reactor temperature of 50° C., the square symbol indicates acetic acid gas bubbler temperature of 58° C. and reactor temperature of 50° C., the diamond symbol acetic acid gas bubbler temperature of 50° C. and reactor temperature 50° C., and the triangle symbol indicates acetic acid gas bubbler temperature of 50° C. and reactor temperature of 34° C. Results are presented in FIGS. 5A–5C for Examples 3a, b, c, d and e representing humidified nitrogen feed to the cathode compartment for I-R MEAs (filled symbols) and HP I-R MEAs (unfilled symbols) operating at different reactor and acetic acid dew point temperatures. The reaction conditions are such that there is acetic acid condensation for the results represented by the circle, square, and triangle symbols but not for the diamonds. The reported spread in the potential for a given current density results from potential "spikes" (IV or greater changes in the cell potential). The cell potential would typically remain at its new "spiked" value for about 10 to about 30 seconds before returning to its original value. The current density increases with cell potential and, at a given cell voltage, increases with a decreases in acetic acid condensation rate. The product ratio is essentially constant at about 0.46 for the I-R MEAs and varies from about 0.39 to about 0.47 for the HP I-R MEAs. The Kolbe current efficiencies vary from about 80 to about 90 percent for the I-R MEAs and between about 36 to about 88 percent for the HP I-R MEAs.

The most favorable current density of 0.3 $A/cm^2$ with 75% current efficiency at a cell potential of −6 V, was obtained using I-R MEAs at the following reaction conditions: 42° C. reactor, 58 mm Hg acetic acid (50° C. acetic acid gas bubbler), and 42° C. liquid water.

What is claimed is:

1. A process for the preparation of organic compounds of the structure (II) from one or more carboxylic acids of the structures (I) and (I') according to the equation

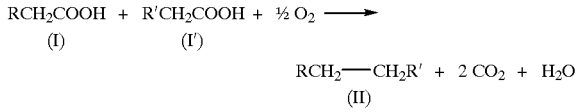

$$\underset{(I)}{RCH_2COOH} + \underset{(I')}{R'CH_2COOH} + \tfrac{1}{2}O_2 \longrightarrow \underset{(II)}{RCH_2{-}CH_2R'} + 2\,CO_2 + H_2O$$

where R and R' are independently selected from the group consisting of hydrogen, alkyl containing from 1 to about 6 carbon atoms, substituted alkyl, phenyl, substituted phenyl, aralkyl and ring-substituted aralkyl, said process comprising the steps of:

a) introducing (I) and (I') in the vapor state or as neat organic liquids in the absence of an organic solvent to the anode side of a polymer electrode membrane reactor;

b) supplying, concurrently, an oxygen carrying gas to the cathode side of said reactor;

c) passing at least one equivalent of electrical current through the polymer electrode membrane reactor resulting in the formation of the compound (II) on the anode side of said reactor and the formation of water on the cathode side of said reactor; and d) isolating the compound (II) from the anode side effluent from the polymer electrode membrane reactor.

2. The process of claim 1, wherein the polymer electrode membrane reactor comprises a gas manifold, flow channels, a membrane electrode assembly, and a current collector.

3. The process as in claim 2, wherein R and R' are the same.

4. The process as in claim 1, wherein the carboxylic acids of the structures (I) and (I') are in the vapor state.

5. The process of claim 4, wherein an inert carrier gas is fed to the anode side of the polymer electrode membrane reactor concurrently with the carboxylic acids.

6. The process of claim 1, operated at a temperature ranging from the freezing point of the carboxylic acids up to about 120° C.

7. A process for the preparation of organic compounds of the structure (II) from one or more carboxylic acids of the structures (I) (I') according to the equation

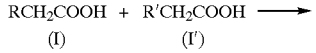

$$\underset{(I)}{RCH_2COOH} + \underset{(I')}{R'CH_2COOH} \longrightarrow$$

-continued $$RCH_2{-}CH_2R' + 2\,CO_2 + H_2$$

(II)

where R and R' are independently selected from the group consisting of hydrogen, alkyl containing from 1 to about 6 carbon atoms, substituted alkyl, phenyl, substituted phenyl, aralkyl and ring-substituted aralkyl, said process comprising the steps of:

a) introducing (I) and (I') in the vapor state in the absence of an organic solvent to the anode side of a polymer electrode membrane reactor;

b) passing at least one equivalent of electrical current through the polymer electrode membrane reactor resulting in the formation of the compound (II) on the anode side of said reactor and the formation of hydrogen on the cathode side of said reactor; and c) isolating the compound (II) from the anode side effluent from the polymer electrode membrane reactor; wherein the polymer electrode membrane reactor comprises a gas manifold, flow channels, a membrane electrode assembly, and a current collector.

8. The process as in claim 7, wherein R and R' are the same.

9. The process of claim 7, wherein an inert carrier gas is fed to the anode side of the polymer electrode membrane reactor concurrently with the carboxylic acids.

* * * * *

UNITED STATES PATENT AND TRADEMARK OFFICE

CERTIFICATE OF CORRECTION

PATENT NO. : 6,238,543 B1 
DATED : May 29, 2001
INVENTOR(S) : Clarence G. Law, Jr. et al.

It is certified that error appears in the above-identified patent and that said Letters Patent is hereby corrected as shown below:

Title page,
Item [73], Assignees, please delete "University of North Carolina, Chapel Hill, NC (US)" and insert in its place -- North Carolina State University, Raleigh, NC (US) --.

Signed and Sealed this

First Day of April, 2003

JAMES E. ROGAN
*Director of the United States Patent and Trademark Office*